United States Patent [19]

Jentoft et al.

[11] Patent Number: 4,757,655

[45] **Date of Patent: * Jul. 19, 1988**

[54] SKYLIGHT CONSTRUCTION

[75] Inventors: Arthur P. Jentoft, Kennebunkport; Paul A. Couture, Emery Mills, both of Me.

[73] Assignee: Wasco Products, Inc., Sanford, Me.

[ * ] Notice: The portion of the term of this patent subsequent to Oct. 18, 2000 has been disclaimed.

[21] Appl. No.: 79,217

[22] Filed: Jul. 29, 1987

Related U.S. Application Data

[60] Continuation of Ser. No. 472,562, Mar. 7, 1983, abandoned, which is a division of Ser. No. 249,072, Mar. 30, 1981.

[51] Int. Cl.[4] ..... E04B 7/18

[52] U.S. Cl. ..... 52/200; 52/397; 49/DIG. 1

[58] Field of Search ..... 52/200, 475, 397, 309.1; 49/DIG. 1, DIG. 2

[56] References Cited

U.S. PATENT DOCUMENTS

| | | | |
|---|---|---|---|
| 3,034,260 | 5/1962 | Wassalman | 52/200 X |
| 3,307,303 | 3/1967 | Bloxsom | 52/200 X |
| 3,417,527 | 12/1968 | Kiekhaefer | 52/200 |
| 3,434,250 | 3/1969 | Kiekhaefer | 52/200 X |
| 3,868,789 | 3/1975 | Gates | 52/309.1 X |
| 4,409,767 | 10/1983 | Jentoft et al. | 52/200 |

FOREIGN PATENT DOCUMENTS

| | | | |
|---|---|---|---|
| 1574137 | 7/1969 | France | 52/200 |

*Primary Examiner*—Carl D. Friedman

*Attorney, Agent, or Firm*—Wolf, Greenfield & Sacks

[57] ABSTRACT

The skylight may be of the domed-type or flat type and of single or double glass (acrylic or other transparent or translucent plastic) construction. The skylight fits within an opening in a roof or the like and has a peripheral curb of an extruded rigid thermoplastic, such as polyvinylchloride (PVC), which is fixed to the roof construction about the opening. The rigid thermoplastic curb has a top co-extruded flexible thermoplastic (such as PVC) gasket intergral with the curb and compressible against the edge of the glass or plastic dome or panel, a second flexible integral co-extruded thermoplastic gasket adapted to contact a retainer secured to the curb for retaining the dome or panel on the curb, and a third co-extruded flexible gasket adapted to contact and seal between the curb and a support wall there below preferably against an outer aluminum wall. The curb is provided with two recesses at its bottom which permit a snap engagement of the inner and outer aluminum walls which form the support for the curb. This snap engagement eliminates welding.

11 Claims, 2 Drawing Sheets

SKYLIGHT CONSTRUCTION

RELATED APPLICATION

This application is a continuation of application Ser. No. 472,562, filed Mar. 7, 1983, now abandoned, which in turn is a division of Ser. No. 249,072, filed Mar. 30, 1981.

BACKGROUND OF THE INVENTION

The present invention relates in general to an improved skylight construction, and is concerned, more particularly with an improved curb frame construction particularly as it pertains to improved thermal characteristics of the skylight and ease of fabrication. The skylight described herein is particularly characterized by an improved resistance to thermal transfer of heat through the skylight.

One typical prior art skylight frame is made of a metal material such as an extruded aluminum. See for example, U.S. Pat. No. 4,073,097. One of the problems with such curb frames is that they permit heat conduction therethrough. Furthermore, there is a tendency in cold weather for condensation to form because of an insufficient temperature differential between the inside and outside of the panels or domes. Accordingly, curb frames have also been constructed of a thermoplastic material such as polyvinylchloride. In either case the thermal transfer is to be minimized.

Accordingly, it is an object of the present invention to provide a skylight construction that is particularly characterized by improved thermal transfer so as to provide increased resistance to thermal transfer of heat through the skylight.

Another object of the present invention is to provide an improved skylight construction that is easier to fabricate providing an interconnecting arrangement for a section of the skylight that does not require welding. More particularly, recesses are provided in the bottom of the curb for permitting a snap engagement of the inner and outer aluminum walls forming the support for under the curb.

Still another object of the present invention is to provide an improved skylight curb frame construction combining a curb of a rigid thermoplastic in combination with a flexible thermoplastic forming a plurality of gaskets for sealing the curb frame to, not only the dome but also the support member for the curb frame.

Another object of the present invention is to provide a skylight construction that minimizes are exfiltration through the skylight. The forming of a positive seal is important with regard to the skylight. The preferred composite PVC is important from the standpoint of energy conservation.

SUMMARY OF THE INVENTION

To accomplish the foregoing and other objects of the invention, there is provided a skylight construction adapted to be fitted into an opening in a building such as the roof of a residential house. This skylight construction comprises a curb frame extending about the opening and having means for receiving nails or the like for securing the frame in place about the opening. In one embodiment, one or more transparent of translucent thermoplastic domes cover the opening and extend at the edge to the curb frame. In another embodiment the dome may be replaced by one or more one or more flat glass panels. A retainer extends about the periphery of the skylight for holding the dome or panel on the curb frame. In accordance with the preferred form of this invention the curb frame is constructed of a rigid plastic, preferably polyvinylchloride (PVC). The curb frame may be heat welded at the corners of the frame and has integral therewith a plurality of gaskets formed of a flexible portion of PVC or the like for sealing between the curb frame and the covering means over the opening. Also, gasket means are provided integral with the curb frame for sealing with the aluminum support wall, particularly the outer aluminum wall. This eliminates energy waste by air infiltration and prevents water leakage. The curb frame may be constructed of a rigid PVC having a hardness in the shore scale for (D), while the gasket may be of a flexible PVC having hardness in the shore hardness range "A". A heat platten, high frequency, ultrasonic or other thermoplastic welding technique may be used to weld the curb, and also at the same time weld the gasket for a continuous seal. This provides an extremely tight skylight construction which is an energy-saving feature of the invention. The curb frame perferably also includes a third gasket that is flexible, integral with the curb frame and contacts the retaining means for the plates or domes to form a seal therewith. The curb frame may have a hollow construction, preferably has weep holes therein, and includes means on the inner side thereof defining a condensation gutter. The curb frame is also preferably provided with two bottom recesses into which the inner and outer aluminum walls snap fit without the requirement for any welding between these walls. These aluminum walls or skins define a compartment for containing fiber glass insulation and form the underside support for the curb frame.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
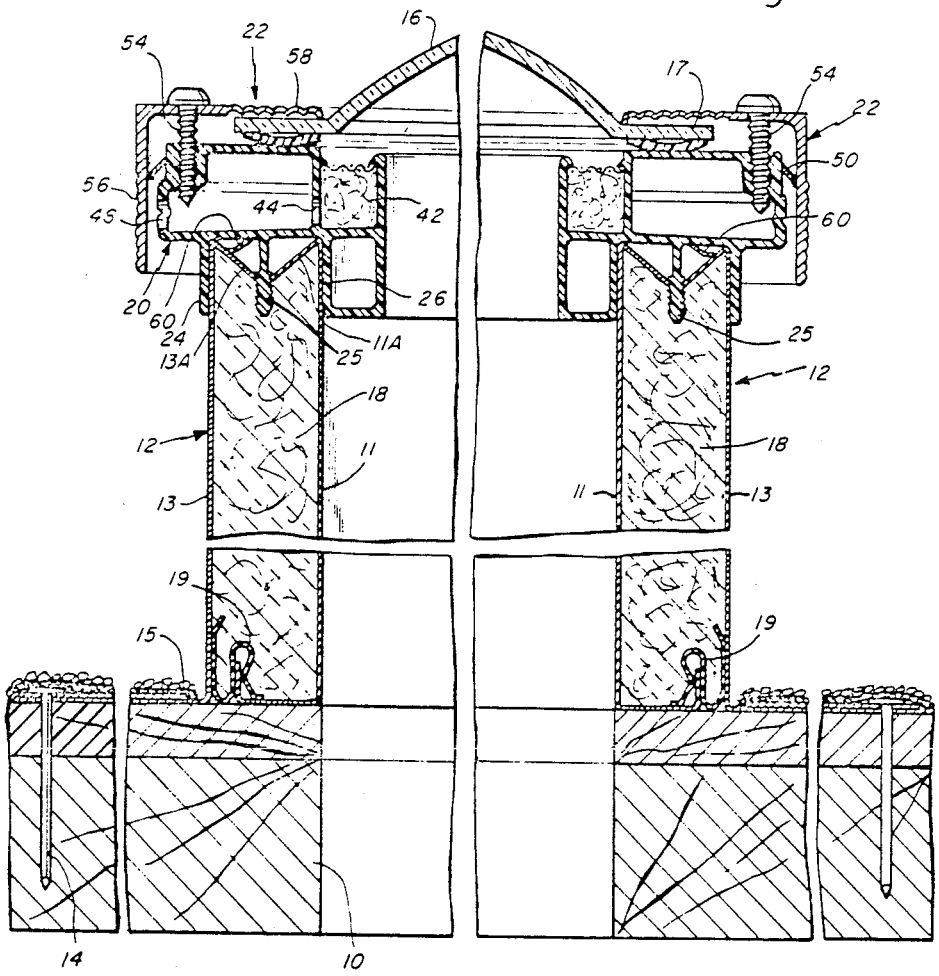
FIG. 1 is a cross-sectional view of a domed skylight construction employing the features of the present invention.
Figure 2:
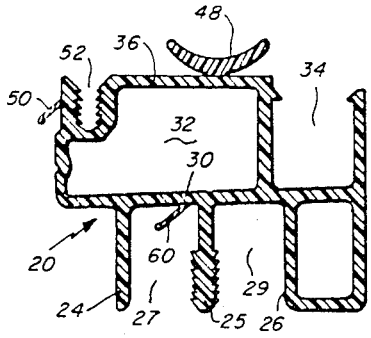
FIG. 2 is a cross-section of the curb frame itself.
Figure 3:
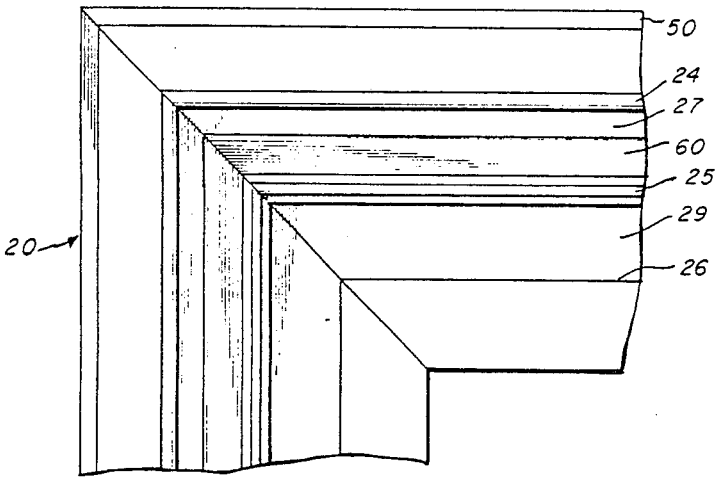
FIG. 3 is a plan view of a portion of the skylight construction of FIG. 1.

Referring now to the drawings, FIGS. 1–3 show an embodiment of the invention incorporating the features of the invention. This embodiment is in the form of a skylight of domedconstruction. It is understood that the principals of this invention may also be applied to a flat type skylight or numerous other forms of skylight construction.

The domed skylight construction disclosed herein spans an opening which may be of square or rectangular shape and defined in part by structural member 10. A series of nails such as nail 14 shown in FIG. 1 is used for securing the skylight to the structural member.

The skylight construction comprises a dome 16 which is preferably an acrylic thermal plastic dome. There is also provided a curb frame 20 of a thermal plastic which is preferably polyvinylchloride (PVC) along with a retainer 22. FIG. 2 is a cross-sectional view showing the construction of the curb frame. FIG. 3 shows a corner of the frame of FIG. 2 showing the corner sealing arrangement.

Over the structural member 10 there is provided a wall 12 that comprises an inner aluminum wall or skin 11 and an outer aluminum wall or skin 13. The wall 13 has an integral curb flange 15 through which the nails 14 penetrate. Other waterproofing means may be also associated with the skylight for securing it about the opening such as felt stripping. The inner and outer skins 11 and 13 define an open space that is to be filled with fiber glass insulation 18. At the lower end of the aluminum walls 11 and 13 there is provided a thermal break 19 which is preferably made of extruded rigid PVC.

FIG. 1 depicts one of the aspects of the present invention wherein the curb frame 20 is provided with downwardly depending walls, such as walls 24 and 26 which along with barbed wall 25 defines a pair of recesses 27 and 29. These recesses permit the snap engagement of the inner and outer aluminum walls without requiring any welding between the aluminum walls 11 and 13. In this regard it is noted in FIG. 1 that the walls extend vertically but have slanted upper ends 11A and 13A with the very ends of these walls snapping into barbs of the wall 25. This provides a united firm interlocking arrangement between the wall means 12 and the curb frame 20.

In addition to the downwardly depending walls just mentioned including walls 24, 25, and 26, there is also provided a base wall 30 and upright walls defining a trough 34. The curb frame 20, of course, also provides support for the dome 16. In one alternate embodiment a pair of domes could be provided. At the wall 36 there is provided a cup shaped sealing gasket 48. In the trough 34 there is preferably disposed a moisture absorbent material 42 which may be a cotton or other fibrous batten of the like. The trough 42 with the absorbent material is for receiving any condensation from the dome 16 and collecting this condensation. The curb frame is preferably also provided with openings or condensation drainage holes 44 and 46 spaced therealong. These are also referred to as weep holes for any excess water permitting the water to be removed from the curb frame.

The extruded curb frame may be constructed of a weatherable rigid thermal plastic material, such as a rigid PVC compound of ASTM-D 1784-69 type 1334-C made by B.F. Goodrich Company of Cleveland, Ohio. The specific gravity of this material is on the order of 1.46. The material has a durometer D hardness of 82±3. The tensile strength is 6200 lbs. per sq. inch and the tensile modulus is 355,000 p.s.i. The IZOD impact at 32° F. is 1.781 lbs. per inch. The heat distortion at 264 p.s.i. is 163° F.

The curb frame also includes an internally threaded recess 52 which receives bolt 54 for securing the retainer 22 to the curb frame 20. It is noted that the gasket 50 is slightly deflected and seals against the wall 56 of the retainer. The top wall 58 of the retainer presses against the edge 17 of the dome 16. The bottom of the edge 17 rests upon the cup-shaped gasket 48 which compresses to seal between the curb frame and the dome.

FIG. 3 shows a corner of the construction of the skylight curb frame wherein two straight sections of extruded curb frame are joined. These sections are joined to form the square or rectangular overall configuration of the curb frame. The joining is preferably accomplished by a heated platten welding technique which welds the section of curb frame at the same time also welding the gaskets 48 and 50.

In addition to the gaskets 48 and 50 there is also provided one other co-extruded flexible gasket 60. This flexible gasket seals the curb frame to the outer aluminum wall 13. This arrangement eliminates energy-wasteful air infiltration and water leakage. As the wall 13 and inparticular the slanted top end 13A is compressed into the recess 27 the wall is urged against the flexible gasket 60.

What is claimed is:

1. A skylight construction for an opening in a building comprising;
   a curb frame extending about the opening,
   translucent or transparent means covering the opening and extending at its edges to the curb frame,
   means for retaining the covering means on the curb frame,
   and support means for the curb frame including inner and outer walls defining a space therebetween for insulation means and wherein the curb frame has a pair of vertically extending and adjacently disposed recesses with each wall having an upper end means for engaging into its corresponding curb frame recess.

2. A skylight construction as set forth in claim 1 wherein said curb frame further includes intercoupling wall means disposed between recesses forming a thermal break between the inner and outer walls.

3. A skylight construction as set forth in claim 2 including a further and separate thermal break disposed between inner and outer walls at the bottom ends thereof.

4. A skylight construction as set forth in claim 1 wherein said inner and outer walls are metal walls.

5. A skylight construction for an opening in a building comprising;
   a curb frame extending about the opening,
   translucent or transparent means covering the opening and extending at the edges to the curb frame,
   means for retaining the covering means on the curb frame, and support means for the curb frame including a pair of inner and outer metal walls defining a space for insulation and wherein the curb frame has a pair of recesses with each wall having an upper end means for engaging into its corresponding curb frame recess and intercoupling wall means disposed between recesses forming a thermal break between the inner and outer metal walls.

6. A skylight construction as set forth in claim 5 wherein said curb frame has at least one gasket for sealing between the curb frame and covering means.

7. A skylight construction as set forth in claim 5 including a further and separate thermal break disposed between inner and outer metal walls at the bottom ends thereof.

8. A skylight construction as set forth in claim 5 wherein the wall end means has a turned end.

9. A skylight construction as set forth in claim 5 wherein said curb frame further includes a intercoupling wall means disposed between recesses forming said first thermal break means.

10. A skylight construction for an opening in a building comprising:
   a curb frame extending about the opening,
   translucent or transparent means covering the opening and extending at the edges to the curb frame, means for retaining the covering means on the curb frame, and support means for the curb frame including a relatively thin wall member, said curb frame having means for receiving the wall member, said wall member having substantially hollow defining a space for insulation, and separate first and second thermal break means spacedly disposed at the respective top and bottom of the wall member separating the wall member into inner and outer walls, said means for receiving the wall member including means defining a pair of vertically extending and adjacently disposed recesses, each of said inner and outer walls having an upper end means for engaging into its corresponding curb frame recess.

11. A skylight construction as set forth in claim 10 wherein said wall member comprises a metal wall member.

* * * * *